US005928075A

United States Patent [19]

Miya et al.

[11] Patent Number: 5,928,075

[45] Date of Patent: Jul. 27, 1999

[54] DISPOSABLE LABORATORY HOOD

[76] Inventors: Terry G. Miya; Jeffrey L. Orth, both of 4249 South 3100 E., Salt Lake City, Utah 84124

[21] Appl. No.: 09/067,057

[22] Filed: Apr. 27, 1998

Related U.S. Application Data

[60] Provisional application No. 60/045,457, May 1, 1997.

[51] Int. Cl.[6] ..... B08B 15/02

[52] U.S. Cl. ..... 454/56; 312/209

[58] Field of Search ..... 454/49, 56, 57, 454/58, 59, 60; 312/209

[56] References Cited

U.S. PATENT DOCUMENTS 4,177,718 12/1979 Grow et al. .
4,534,281 8/1985 Parks et al. .
4,548,128 10/1985 Morikawa et al. .
4,632,022 12/1986 Baitinger et al. .
4,856,420 8/1989 Poblete et al. .
5,056,422 10/1991 Horntvedt .
5,318,473 6/1994 Goemans et al. .
5,407,389 4/1995 Poblete et al. .
5,413,408 5/1995 Beck et al. .
5,447,468 9/1995 Tener et al. .

*Primary Examiner*—Harold Joyce
*Attorney, Agent, or Firm*—Trask, Britt & Rossa

[57] ABSTRACT

A disposable laboratory hood has a base, a left side, a right side and a rear side all formed of a coated cardboard laminate. A clear, transparent film extends between the sides to define an access opening through which the user may insert his or her hands to perform laboratory procedures. A front is secured to the base and is rotatable to cover the access opening to provide for a closed interior. A filter and a blower may be connectable if desired.

24 Claims, 6 Drawing Sheets

DISPOSABLE LABORATORY HOOD

RELATED APPLICATION

This application is a continuation of and claims the benefit of the filing date of U.S. Provisional application Ser. No. 06/045,457, filed May 1, 1997.

BACKGROUND OF THE INVENTION

1. Field of the Invention

This invention relates to disposable laboratory devices and, more specifically, to a disposable laboratory hood, a still air enclosure or a dead air box to contain selected chemicals or biological material while performing laboratory procedures.

2. State of the Art

In a laboratory setting, particular laboratory procedures may involve use of a number of different chemical and biological materials that may need to be controlled. Steps are typically taken to protect against release of the involved materials to the atmosphere or to control them to avoid contaminating structures and/or laboratory workers. Of course, it may also be desirable to closely contain materials prepared for certain experiments so they may remain uncontaminated and in a protected environment and inhibit their accidental release into the surrounding area.

In order to provide a containment, it is understood that small laboratory work stations have been proposed. Such may be made out of a variety of cleanable or rigid materials including, for example, stainless steel, so that laboratory procedures may be performed in a relatively sterile, cleanable and protected area.

In other cases, fume hoods have been devised including, for example, a fume hood that is illustrated and described in U.S. Pat. No. 4,856,420 (Poblete et al.). Alternative fume hood configurations may be found in U.S. Pat. No. 4,632,022 (Baltinger et al.), U.S. Pat. No. 4,548,128 (Morikawa et al.), U.S. Pat. No. 4,534,281 (Parks et al.), and U.S. Pat. No. 4,177,718 (Grow et al.). The known fume hoods, as well as other laboratory work stations, are believed to be susceptible to contamination. In such an event, disposal is a problem.

There is a need for a laboratory hood, "still air enclosure" or "dead air box" which is disposable yet at the same time is essentially impervious to selected chemical and biological materials.

BRIEF SUMMARY OF THE INVENTION

A disposable laboratory hood includes an enclosure. The enclosure has a base having a left edge, a right edge and a rear edge. The enclosure also has a left side with a left bottom edge and a left top edge. The enclosure further has a right side having a right bottom edge and a right top edge. Left connecting means are provided for connecting the left bottom edge of the left side to the left edge of the base. Right connecting means are also provided for connecting the right bottom edge of the right side to the right edge of the base.

The enclosure also has a rear side having a rear bottom edge and a rear top edge. Rear connecting means are provided for connecting the rear bottom edge of the rear side to the rear edge of the base.

The base, the left side and the right side, as well as the rear side, are assembled to define an interior. Each is formed of a laminate material having one layer which is preferably the interior layer that is selected to be essentially impervious to the transmission of selected chemical and biological materials. The other layer is formed of a low cost disposable material of sufficient rigidity to define substantially rigid surfaces. Most preferably, the other layer is corrugated cardboard. The interior layer is an elastomeric film coating and most desirably is sterilized.

The disposable laboratory hood also includes cover means sealably attached proximate to the top edge of the left side and proximate to the right top edge of the right side. The cover means is sized to extend between the left top edge and the right top edge, as well as the rear top edge, and over the interior. The cover means defines an access opening between the left side and the right side, as well as between the base and the cover means. The cover means is preferably formed of a material that is selected to be resistant to the transmission of selected chemical and biological materials. More preferably, it is a thin, transparent, flexible, plastic-like material that is essentially transparent.

In a preferred arrangement, the left side has a left front edge and a left slant edge extending between the left top edge to the left front edge. The right side also has a right front edge and a right slant edge extending between the right top edge to the right front edge. The cover means extends from the top edge of the left side and the top edge of the right side toward the front edge of the left side and the front edge of the right side along the left slant edge and the right slant edge.

The cover means desirably is sealed to the left side and the right side along the left slant edge and along the left top edge. The cover means is preferably also sealed to the right side along the right slant edge and along the right top edge.

In preferred configurations, the left side is rotatable between a first position oriented toward the base and an upright position oriented generally normal to the base. The right side is also preferably rotatable between a first position oriented toward the base and an upright position oriented generally normal to the base. The rear side is also rotatable between a first position oriented toward the base and an upright position oriented generally normal to the base.

In a desired embodiment, the left side has a rear edge and the rear side has a left edge. A first locking side is sealingly connected to either the rear edge of the left side or the left edge of the rear side. Second left connecting means are provided for connecting the first locking side to one of the rear edge of the left side and the left edge of the rear side.

The right side also preferably includes a rear edge and the rear side includes a right edge. The disposable laboratory hood further includes a second locking side sealingly connected to either the rear edge of the right side or the right edge of the rear side. Second right connecting means are provided for connecting the second locking side to one of the rear edge of the right side and the right edge of the rear side. The first locking side and the second locking side are each most preferably formed of the same laminate material as the base, left side, right side and rear side.

The base preferably has a front edge opposite its rear edge. The disposable laboratory hood further includes a front side connected to the front edge of the base. The front side extends between the front edge of the left side and the front edge of the right side. The front side also extends from the base toward the cover means a preselected distance which is preferably selected to extend proximate and more preferably over a portion of the cover means.

Left front connection means and right front connection means are provided for connecting the front side to the left side and the right side. The front is desirably rotatable between an upright position oriented generally normal to the base and a second position oriented away from the upright position.

The left front connection means preferably has a left flap attached to a left edge of the front side. The left front connection means also include locking means for removably locking the left flap to the left side. The front side also a right edge. Right front connection means includes a right flap attached to the right edge and right locking means for removably locking the right flap to the right side.

The left locking means desirably includes the first button attached to the left flap and the second button attached to the left side with left engaging means for engaging and inhibiting relative movement between the first button and the second button. The left engaging means may include a rubber band or string.

The right locking means includes a third button attached to the right flap and a fourth button attached to the right side with right engaging means for engaging and inhibiting relative movement between the third button and the fourth button. The right engaging means may be a string or a rubber band.

The left locking means and the right locking means may alternatively include a tongue formed on the edge of the left flap and the right flap with a corresponding left slot and right slot formed in the left side and the right side for frictional engagement of the tongues with their respective left slot and right slot.

In an alternative configuration, one of the left side, rear side and the right side has an aperture formed therein with a filter structure positioned proximate thereto to filter air moving through the aperture. Fan means is connected to the aperture to move air through the aperture and, in turn, through the filter.

DETAILED DESCRIPTION OF THE INVENTION

Figure 1:
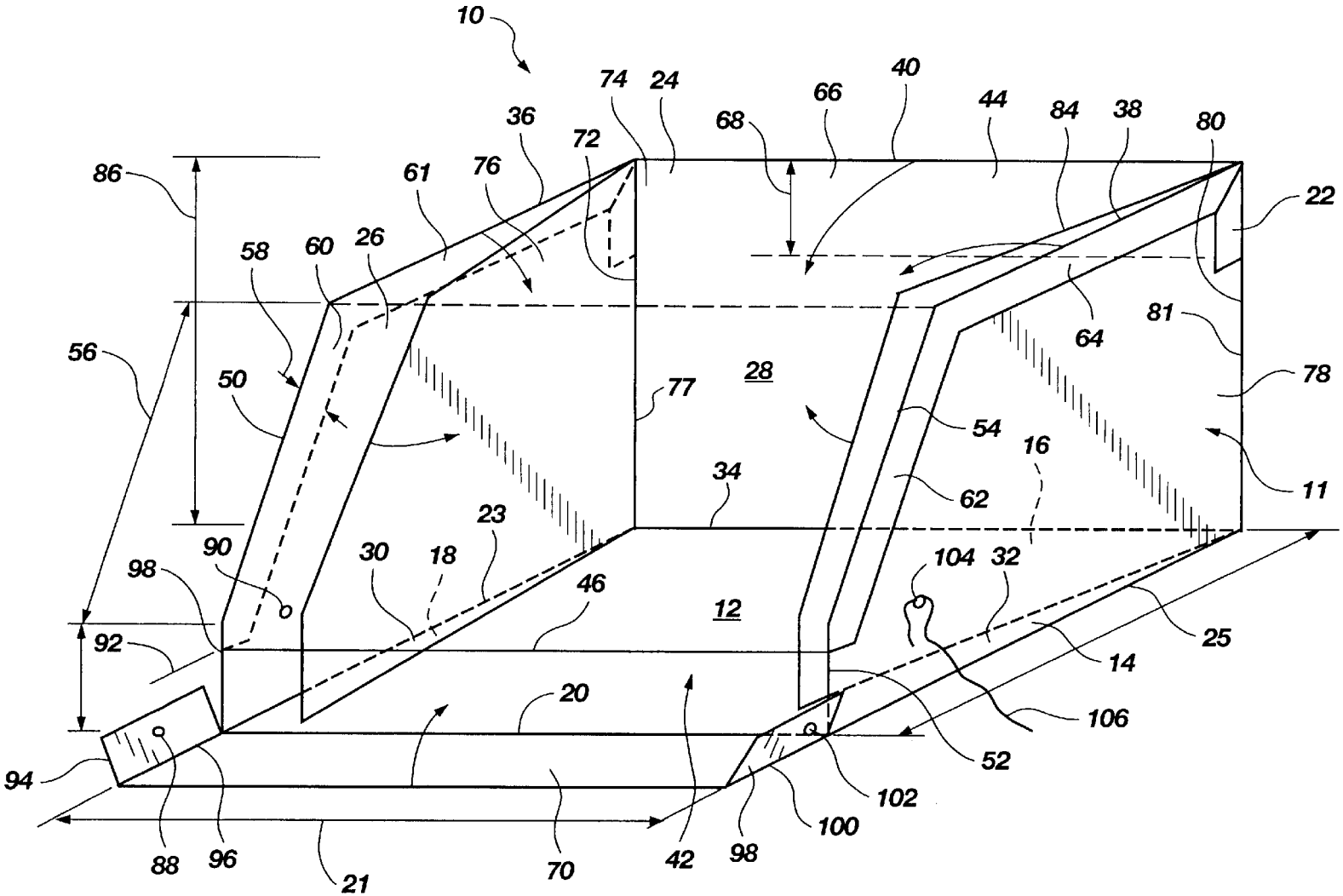
FIG. 1 is a perspective of a disposable laboratory hood of the present invention.

A disposable laboratory hood 10 has an enclosure 11 formed with a base 12 which is generally rectilinear in configuration. The base 12 has a right edge 14, rear edge 16, left edge 18 and front edge 20. Although the base 12 is shown to be generally rectilinear in configuration, other geometric shapes may be presented. For example, the right edge 14 and left edge 18 are here shown to be generally straight and normal to the rear edge 16. However, a curvilinear or arced configuration may be provided in selected applications. Alternatively, the front edge and the rear edge may be of different widths 21. Indeed, the base may even be triangular or semicircular in shape. Other geometric shapes may also be suitable for selected applications.

The disposable laboratory hood 10 has an enclosure 11 which is defined by the base, as well as by the right side 22, rear side 24 and left side 26. That is, the right side 22, rear side 24 and left side 26 are each assembled to define an interior 28. The left side 26 has a left bottom edge 30 with left connecting means for connecting the left bottom edge 30 to the left edge 18 of the base 12. The left connecting means may be any acceptable connecting arrangement to provide for rotational relationship between the left side 26 and the base 12. Inasmuch as the base 12 and the left side 26 are both formed of the same laminate material, the left connecting means is here preferably simply a crease or folding area 23 formed in the laminate material so that the left side 26 may easily rotate into an upright configuration as illustrated in FIG. 1 and a collapsed or stored configuration as discussed hereinafter.

The right side 22 has a right bottom edge 32. Right connecting means is provided for connecting the right bottom edge 32 to the right edge 14 of the base 12. The right connecting means is similar to the left connecting means and is desirably a crease or fold 25 in the laminate material of which both the base 12 and the right side 22 are formed.

The rear side 24 also has a rear bottom edge 34. The rear bottom edge 34 is connected to the rear edge 16 of the base 12 by rear connecting means to be rotatable from a stored configuration to an upright configuration as depicted. The rear connecting means is comparable to the right connecting means and the left connecting means and is preferably a crease in the laminate material from which the base 12 and the rear side 24 are each formed.

In FIG. 1, the disposable laboratory hood 10 also includes cover means sealingly attached proximate the left top edge 36 of the left side 26 and the right top edge 38 of the right side 22. The cover means is here shown as a cover 44 sized to extend between the left top edge 36 and the right top edge 38 and over the rear top edge 40 of the rear side 24. The cover 44 extends over the interior 28 and is configured to define an access opening 42. More specifically, the cover 44 extends from the rear top edge 40 over the left top edge 36 and right top edge 38 downward to a lower edge 46 to enclose the interior 28 and to define the access opening 42. The access opening 42 extends from the lower edge 46 to the front edge 20 of the base 12 and between the left side 26 and the right side 22. The cover 44 is formed of a material that is resistant to the transmission of selected chemical and biological materials. Preferably, the cover 44 is made of a clear translucent material and preferably a plastic-like film. Suitable plastic-like films include 3 to 4 mil transparent PVC or polyethylene available from Ling Products of Neenah, Wis. and Polar Plastics Mfg. Ltd. of St. Laurent, Quebec, Canada, respectively. However, in some applications, any form of translucent polymeric film will be sufficient.

As can be seen in FIG. 1, the left side 26 has a left front edge 48 and a left slant edge 50 that extends from the left top edge 36 to the left front edge 48. Similarly, the right side 22 has a right front edge 52 and a right slant edge 54. The right slant edge 54 extends from the right top edge 38 to the right front edge 52. Although the cover 44 is here shown with its lower edge 46 extending along the entire length 56 of the left slant edge 50 and the right slant edge 54 to the left front edge 48 and the right front edge 52, it should be understood that the lower edge 46 of the cover 44 need only extend a preselected portion of the distance or length 56 of the slant edge 50 and 54. Desirably, the cover 44 is sealed to the left slant edge 50 and to the right slant edge 54.

As shown in FIG. 1, the cover 44 extends over the left slant edge 50 a distance 58 and is sealed to the left side 26 by any acceptable means. For example, various double-backed tapes may be positioned between the left side 26 and the cover 44 and, more particularly, the sealing portion 60 of the cover 44. Alternatively, the sealing portion 60 may be glued, heat-sealed or even stapled as desired. Similarly, the sealing portion 61 extending along the left top edge 36 of the left side 26 is also secured to the left side 26 by any acceptable sealing arrangement.

A sealing portion 62 of the cover 44 extends over the right slant edge 54. The cover 44 has a sealing portion 64 which extends along the right top edge 38 generally as illustrated in FIG. 1. The sealing portions 62 and 64 are attached to the right side 22 by means similar to those selected for sealing portions 60 and 61.

The cover 44 also has a rear overlap 66 which extends from the rear top edge 40 of the rear side 24 a distance 68 which is selected to be at least one inch but may extend a distance so that a snug, relatively airtight, fit may be effected along the rear top edge 40 and in turn along the exterior of the rear side 24. In the illustrated embodiment, the rear side 24 is not adhesively attached to the rear overlap 66. In some situations, hook and pile fasteners which may be VELCRO® strips could be attached to the back side or outside of the rear side 24 and to the lower portion of the rear overlap 66 to effect a tighter but removable connection.

It can also be seen in FIG. 1, that a front 70 is provided that is rotatably secured to the front edge 20 of the base 12 by front connecting means. The front 70 rotates from a first position, as shown in FIG. 1, to a secure position in which the front 70 is positioned toward and over the access opening 42. Securing means are provided for securing the front 70 to left side 26 and the right side 22 when in the secure position in order to cover the access opening 42. The front connecting means may be comparable to the left, right, and rear connecting means.

Figure 6:
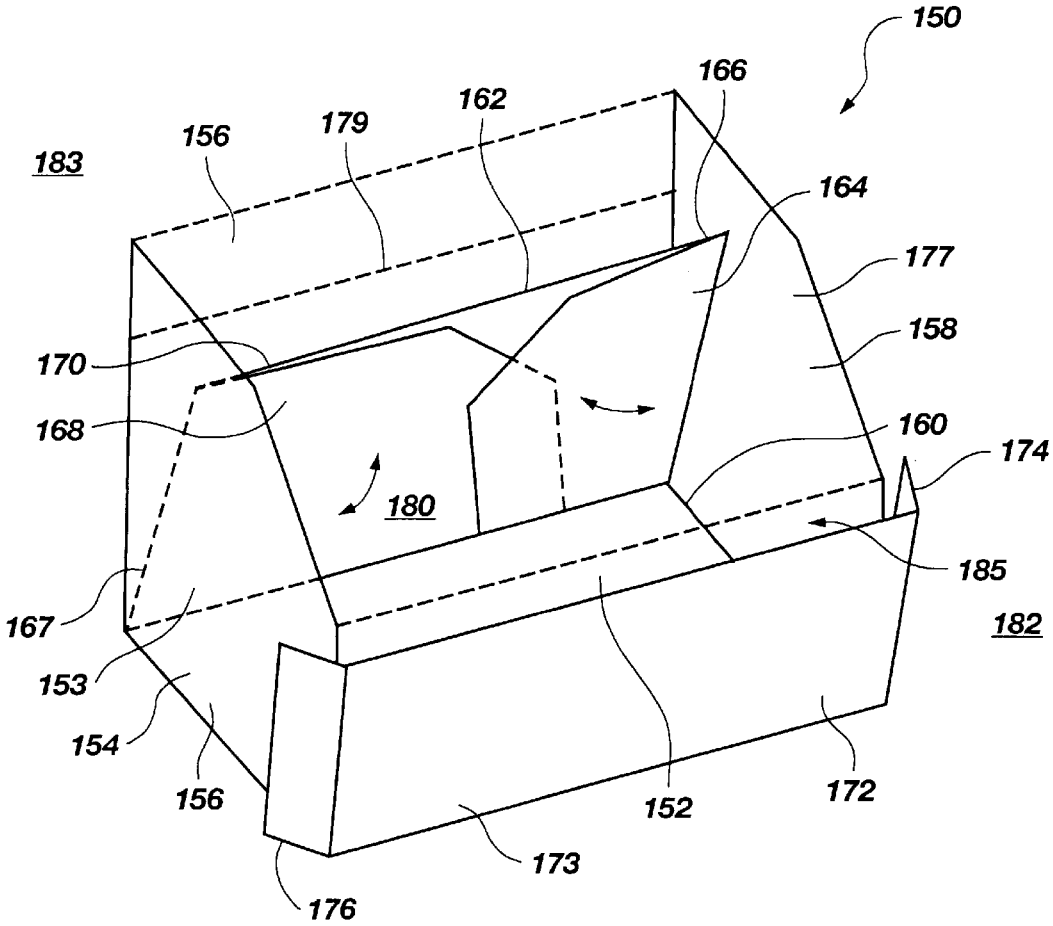
FIG. 6 is a perspective view of a disposable laboratory hood of the invention in a partially assembled configuration.
Figure 8:
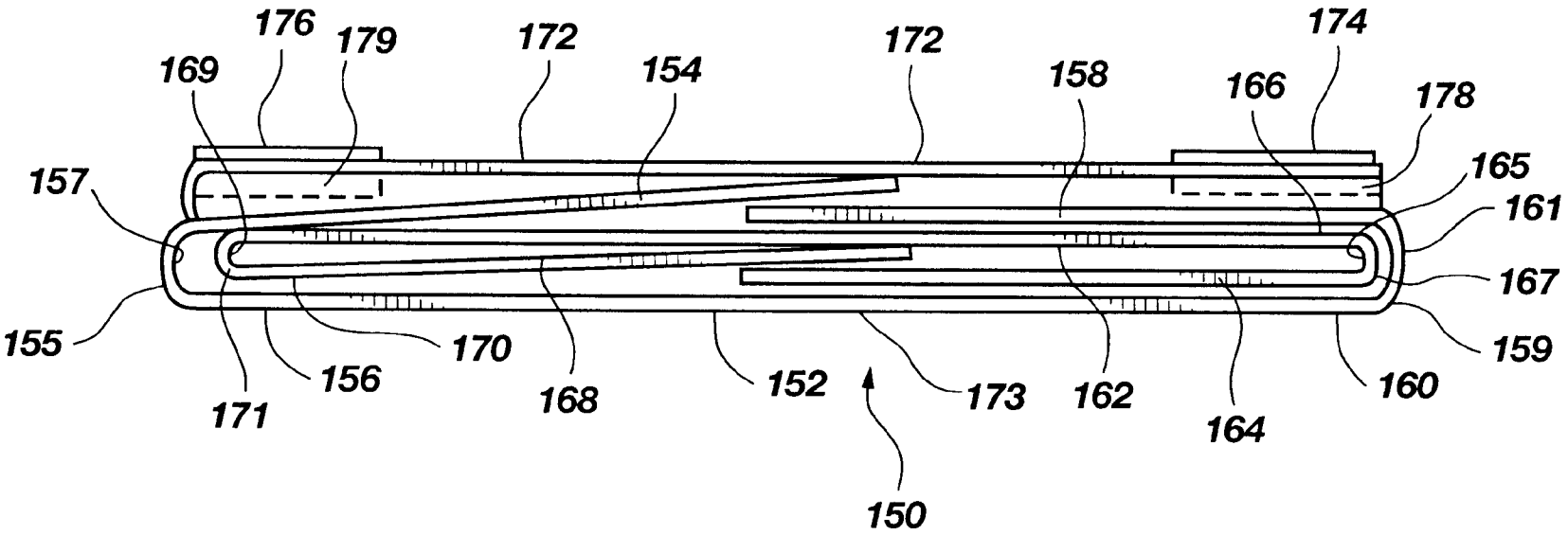
FIG. 8 shows a disposable laboratory hood in a collapsed configuration.

The left side 26, the right side 22 and the rear side 24 are each rotatable between stored positions toward the base 12 and upright positions, as illustrated in FIGS. 1, 6 and 8, and as more fully discussed hereinafter.

The left side 26 has a left rear edge 72; and the rear side 24 has a left edge 74. The disposable laboratory hood 10 and, more particularly, the enclosure 11, has a first locking side 76 which is sealingly connected to either the left rear edge 72 of the left side 26 or the left edge 74 of the rear side 24. The second left connecting means is preferably a crease 77 formed in the laminate material of which the first locking side 76 and the left side 26 and the rear side 24 are formed. Desirably, the first locking side 76 is rotatably secured to the left edge 74 of the rear side 24. When so connected, the first locking side 76 is configured to rotate outwardly against the left side 26 to lock the rear side 24 relative to the left side 26. The second left connecting means also functions to seal the corner between the left side 26 and the rear side 24. Alternatively, the first locking side may be connected to the left rear edge 72 by the same second left connecting means. As so configured, the first locking side is configured to rotate toward the rear side 24 to lock the left side 26 relative to the rear side 24.

In a similar fashion, the right side 22 has a rear edge 78 and the rear side 24 has a right edge 80. Second right connecting means are provided for connecting the second locking side 84 to one of the rear edge 78 and the right edge 80. Preferably, the second right connecting means is a crease 81 formed in the laminate material from which the right side 22, second locking side 84 and the rear side 24 are formed. Desirably, the second locking side 84 is rotatably connected to the right edge 80 of the rear side 24. Alternatively, the second locking side 84 may be connected to the right edge 80 of the rear side 24. When so connected, it is shaped similar to the first locking side 76. As illustrated, both the first locking side 76 and the second locking side 84 are both sized to be substantially identical in dimensions with their respective left side 26 and right side 22.

In FIG. 1, the first locking side 76 and the second locking side 84 are both shown rotatably spaced away from their respective left side 26 and right side 22 to facilitate illustration.

Preferably, the disposable laboratory hood 10 and, more particularly, the enclosure 11, has a height 86 which is selected to be sufficient to provide an interior 28 sized so that a laboratory technician may be able to perform a variety of laboratory functions within the interior 28 with the technician's arms extending through the access opening 42 and with the cover 44 in place providing a transparent surface through which the laboratory technician may observe hand motion and other procedural operations. Of course, the cover 44 provides visibility while at the same time restricting the transmission of chemical and biological materials which are desired to be contained in the interior 28. The interior 28 is illuminated by ambient light through the transparent cover 44.

As hereinbefore stated, the front 70 is attached to the front edge 20 of the base 12 by front connecting means comparable to the left connecting means and right connecting means. The front 70 is rotatable from a first position (shown) to a second position in which the front is positioned over the access opening 42. Left securing means and right securing means are provided in order to secure the front 70 to the left side 26 and the right side 22, respectively. As shown in FIG. 1, the left securing means includes left flap 94 and locking means for locking the left flap 94 to the exterior of the left side 26. The locking means shown includes a first button 88 shown in phantom and a second button 90 also shown in phantom with a string 92 available for winding thereabout. Left flap 94 is formed along the left edge 96 of the front 70. Similarly, right securing means includes right flap 98 formed along the right edge 100 of the front 70. Locking means includes a third button 102 positioned on the right flap 98 and a fourth button 104 positioned on the exterior of the right side 22. A string 106 is provided which the user may wind around the respective buttons 102 and 104 in order to secure the front 70 over the access opening 42.

Figure 2:
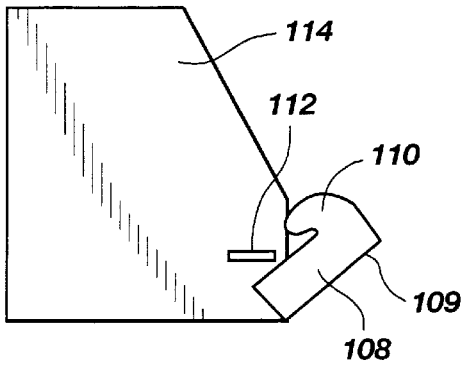
FIGS. 2–5 are side views of a disposable laboratory hood of the present invention depicting alternate structure for locking a front side to the sides of a disposable laboratory hood of the present invention.

As can be seen in FIG. 2, the left flap 108 is there shown formed with a tongue 110 configured to interact with a slot 112 formed in the left side 114. Upon rotation of the front 109 over the access opening (similar to access opening 42), the tongue 110 is frictionally inserted into the slot 112 to secure the front 108 over the access opening.

Figure 3:
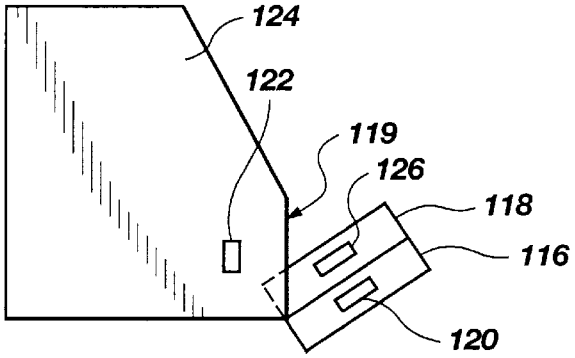

In FIG. 3, a left flap 116 and a right flap 118 are connected to a front that can be rotated over the access opening 119. A hook or pile 120 is associated with the left flap 116 and is configured to register with a corresponding alternate hook or pile 122 attached to the left side 124 of an enclosure of a laboratory hood of the invention. Similarly, a right hook or pile 126 is attached to the right flap 118 and positioned to register with a corresponding hook or pile (not shown) associated with the right side of the enclosure structure of FIG. 3. A VELCRO® hook or pile structure is preferred.

Figure 4:
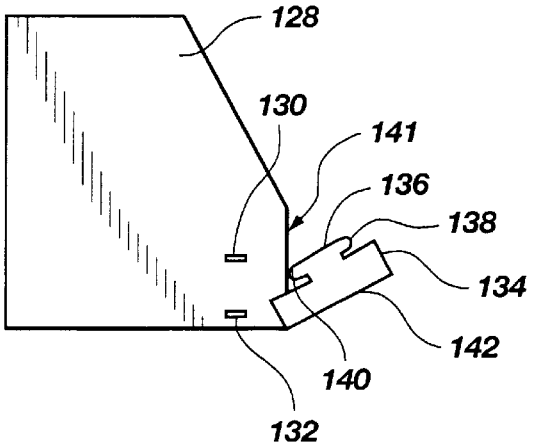

As can be seen in FIG. 4, the left side 128 of an enclosure may be formed with an upper slot 130 and a lower slot 132. A left flap 134 is formed with a tongue 136 having an upper tab 138 and a lower tab 140. The tabs 138 and 140 are positioned to frictionally engage the slots 132 and 130 in order to hold the left flap 134 and, in turn, the front 142 over the access opening 141.

Figure 5:
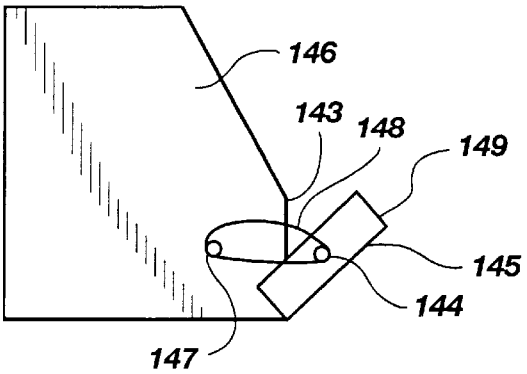

In FIG. 5, the left side 146 of the enclosure is also shown with a button 147. The left flap 149 has a button 144. A rubber band 148 is shown in a stretched condition extending between the buttons 144 and 147 in order to urge the left flap 149 and, in turn, the front 145 toward the access opening 143. Alternatively, a string attached to one button 147 may be wrapped around the other button 144 to create the interior space.

In reference to FIGS. 6 and 8, a laboratory hood of the invention 150 is shown having a base 152. A left side 154 is shown rotatably connected to the left edge 156 of the base by left connecting means which is here shown to include a fold section 155 and a crease 157. Similarly, the right side 158 is rotatably secured to the right edge 160 of the base 152 by right connecting means which includes a fold section 159 and a crease 161. The rear side 162 is rotatably secured to the base 152 along its rear edge by rear connecting means comparable to the left connecting means and the right connecting means. The rear side 162 has a second locking side 164 rotatably secured thereto by second right connecting means having a crease 165 and a fold section 167 along a right edge 166 of the rear side 162. Similarly, a first locking side 168 is shown rotatably secured to the left edge 170 of the rear side 162 by second left connecting means which includes a crease 169 and a fold section 171. The front 172 is shown in FIG. 8 cut away from the front edge 173 of the base 152. The front 172 has a right flap 174 and a left flap 176. Notably, the right flap 174 and left flap 176 may be positioned as shown in FIG. 8, not only in solid, but also in dotted position or alternative locations shown in phantom at 178 and 179.

In FIG. 8, a cover comparable to cover 151 (FIG. 6) is not shown. However, with a cover such as cover 151 attached, it should be understood that the rear side 162 is first folded toward the base 152, then either the left side 154 or the right side 158 are folded so that the cover 151 folds over or on top of the outside 153 of the left side 154 and under or inside of the inside 177 of the right side 158.

Figure 7:
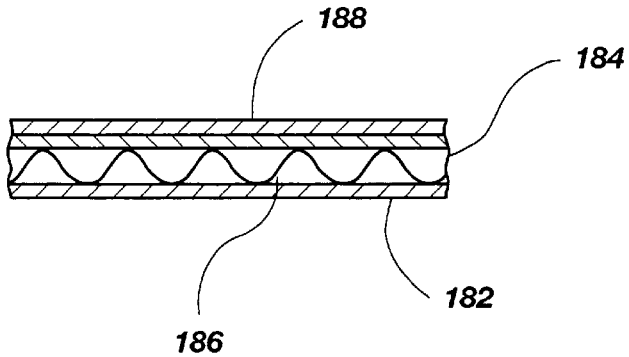
FIG. 7 is a partial cross-sectional enlarged depiction of a portion of a side of the disposable laboratory hood of FIGS. 1–6.

The left side, right side, rear side, first locking side and second locking side, as well as the front of the enclosure, are formed of a laminate material shown in cross section in FIG. 7. The first layer is a corrugated cardboard layer having an exterior surface 182 and an interior surface 184 with an undulating material 186 thereinbetween. The second layer 188 is the water-based silicone elastomer, such as the Dow Corning 84, 85 additive material available from Dow Corning of Midland, Mich. That is, the additive is placed over the interior surface 184 of the corrugated material to form a second layer which is here shown substantially larger and disproportionately thicker to the actual materials. That is, the water-based silicone elastomer may be several mils thick which is sufficient to act as a substantially impervious barrier to chemical and biological materials that may be used in a variety of traditional, medical and experimental testing environments. Notably, a water-based silicone elastomer is also preferred because it can be cleaned so that the enclosure and, more particularly, the disposable chemical hood can be reused for a number of applications before disposal.

Although a water-based silicone elastomer is here described as a preferred material, alternative materials may be used so long as they provide for continued flexible relationship as hereinbefore described and also provide for a resistive barrier to the transmission of biological materials and chemicals. Further, the first layer has been stated to be cardboard because it is a recognized low cost, non-woven material that can be recycled, burned or otherwise disposed of more easily than, for example, a metallic material. Other materials may be used in lieu of cardboard so long as they provide acceptable rigidity and are disposable or recyclable or both.

Figure 9:
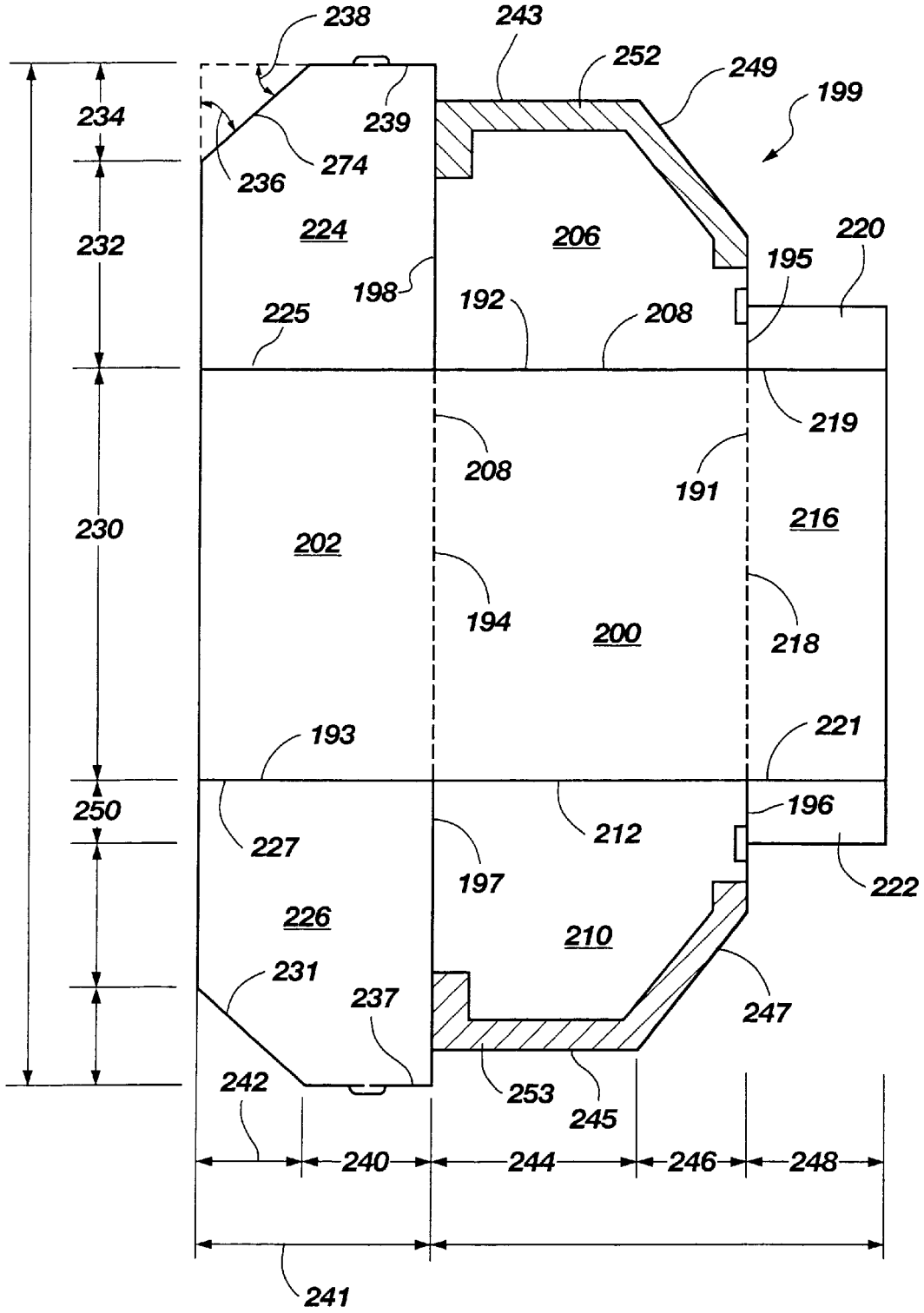
FIG. 9 shows the sides, front and base of a disposable laboratory hood of the invention in a plan configuration.

FIG. 9 shows a cut out or blank 199 of a disposable laboratory hood. That is, a die may be made which is pressed or forced against a section of laminated material to form the blank or cut out 199 shown in planar orientation in FIG. 9. After formation, the blank is cut along the solid lines 195–198 so that it may be folded to the configurations of FIG. 1 and FIG. 8. The die may press the laminate to form creases or dents in the laminate or fold sections all generally depicted by the dotted lines 191–194.

The cut out or blank 199 has a base 200 with a rear side 202 rotatably secured thereto by rear connecting means 204. It also has a right side 206 secured by right connecting means 208 and a left side 210 secured by left connecting means 212. A front 216 is shown secured by front connecting means 218. A right flap 220 and a left flap 222 are also shown rotatably attached to the front 216 by respective connecting means 219 and 221. A second locking side 224 and a first locking side 226 are shown rotatably secured to the rear side 202 by connecting means 225 and 227. The overall width 230 of the rear side may be any desired dimension, but in one version is about twenty-four inches. Both the first locking side 226 and the second locking side 224 have a top edge sized in length 232 to be about one foot. Their respective slant edges 229 and 231 provide an additional length 234 of about six inches. The slant edges 229 and 231 are formed at roughly 45° angles 236 and 238 as shown. The rear side 202, as well as the second locking side 224 and the first locking side 226, are formed to each have a total height 241 of about fourteen inches with the front edges 237 and 239 having a height 240 of about eight inches. The slant edges 229 and 231 have a height 242 of about six inches. The top edge 243 of the right side 206 and the top edge 245 of the left side 210 each have a length 244 of about twelve inches with the slant edges 247 and 249 providing for an additional length 246 of about six inches. The front 216 has a height 248 of about eight inches. The left flap 222 has a width 250 of about four inches; and the right flap 220 is similarly sized.

Areas for sealing connection of the cover, such as cover 44, to the right side 206 and the left side 210 are shown in a gray shade format 252 and 253.

It should also be noted that the connecting means for connecting the sides and the front to base and the locking members to the left and right sides or rear side have been described as a crease formed in the laminate with a fold section. As illustrated in FIG. 8, the fold sections are larger and disproportionate to facilitate illustration. It should also be understood that the connecting means may be cloth hinges formed of a tightly woven (e.g., nylon duck) a non-woven (e.g., paper, Teflon) material. Indeed, any suitable material that provides for the relative movement of the component sides and acts as an isolation barrier may be used.

Figure 10:
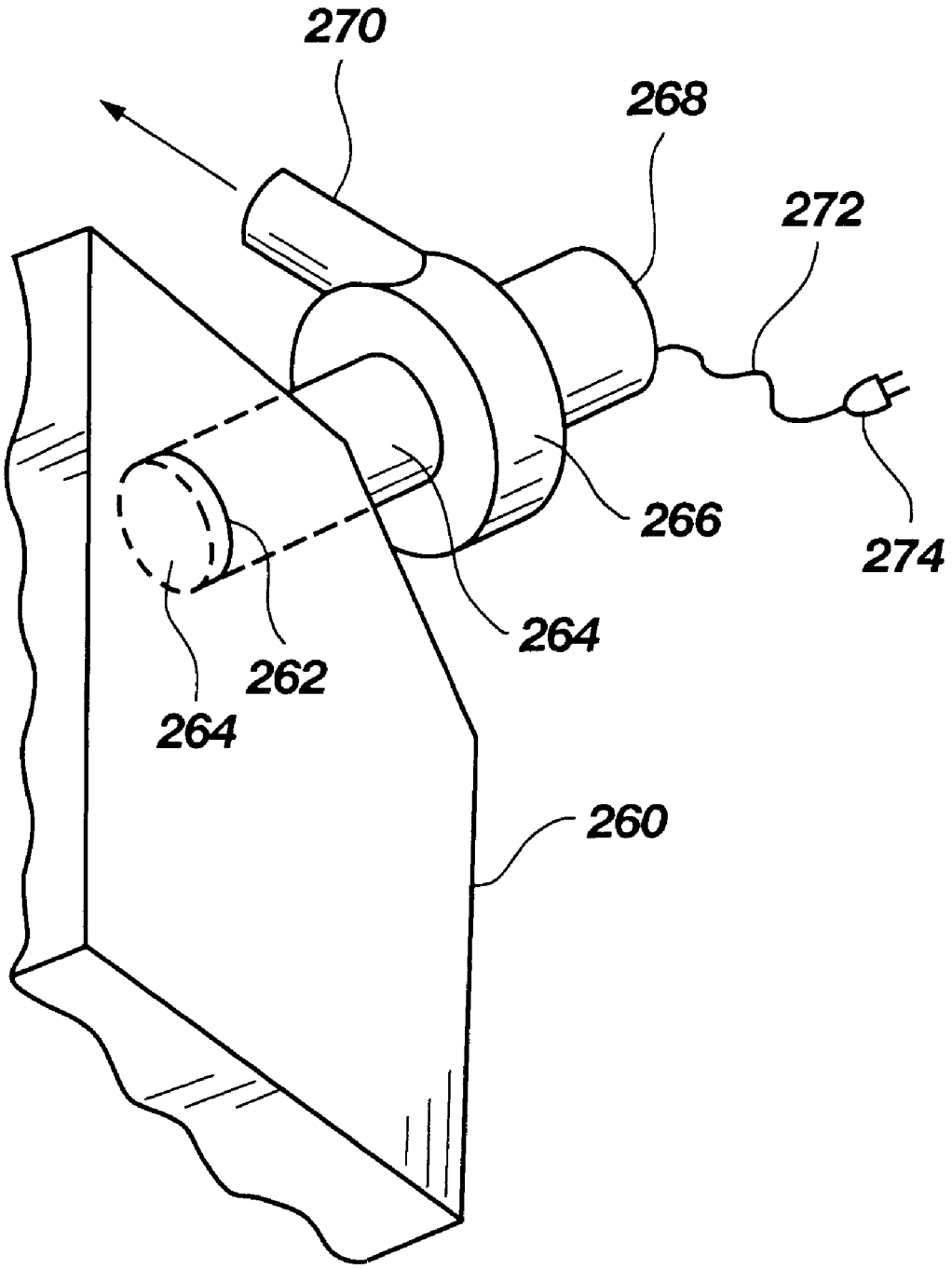
FIG. 10 shows a side of a disposable laboratory hood of the present invention with a filter and fan associated therewith.

Referring now to FIG. 10, a right side 260 is formed with an aperture 262 therethrough. A filter 264 is shown over the aperture. The filter 264 may include any suitable filter media to collect or filter to remove whatever material may be deemed hazardous. The filter may be of 3M™ Filtrete Air Filter Media, 3M Corp., St. Paul, Minn. Alternatively, the filter may include activated charcoal and sections to electrolitically process or clean passing air.

A blower means having an exhaust conduit 264, a fan 266 and a drive motor 268, is shown in FIG. 10. The fan 266 has an exhaust or discharge 270. The motor 268 of the fan 266 is electrically driven and may be powered through a conventional cord 272 connected by a plug 274 to an available outlet.

The motor 268 may be variable speed or operable at different speeds so that a user may select a desired air flow to cause air to move inward through the access opening, such as access opening 42 in FIG. 1, and through the interior, such as the interior 28 of FIG. 1, and out through the filter 264. In turn, chemical and biological materials are retained within the interior 28 by an inward air flow at the access.

In use, the disposable laboratory hood 150 of the invention of FIGS. 6 and 8 may be collapsed into a configuration, such as that shown in FIG. 8, for shipping and storage. To assemble, the user first moves the front 172 (FIG. 1) away from the collapsed assembly so that the corresponding left side 154 and right side 158 may be raised. As they are raised, the associated cover 151 is simultaneously put into place. The rear side 162 may then be raised and positioned snugly against the overlap 179 of the cover. Thus, a sealing relationship can be provided in order to restrict the movement of chemical and biological materials from the interior 180 to the exterior 183 of the laboratory hood. Next, the first locking side 168 and the second locking side 164 are rotated toward the left side 154 and the right side 158 to lock the rear side 162 in place relative to the base 152 and the left side 154 and the right side 158. To use the hood, the user positions his or her hands and fore arms through the access 185 to manipulate chemical materials and devices placed in the interior 180. When operations are to be terminated, the user removes his or her hands. The front 172 may then be positioned and secured over the access 185 in order to retain work and related chemical and biological materials therewithin.

Those skilled in the art will recognize that the various embodiments herein described simply illustrate the principles of the invention which are themselves set forth in the detailed claims appended hereto. Notably, the laboratory hood may be shaped or formed in a wide variety of geometric shapes as desired.

What is claimed is:

1. A disposable laboratory hood comprising:

an enclosure including a base having a left edge, a right edge and a rear edge, a left side having a left bottom edge and a left top edge, left connecting means for connecting said left bottom edge to said left edge of said base, a right side having a right bottom edge and a right top edge, right connecting means for connecting said right bottom edge to said right edge of said base, a rear side having a rear bottom edge and a rear top edge, rear connecting means for connecting said rear bottom edge to said rear edge of said base, said base, said left side, said right side and said rear side each being assembled to define an interior and each being formed of a laminate having one layer that is selected to be resistant to the transmission of selected chemical and biological materials;

cover means sealingly connected proximate to said left top edge and to said right top edge and sized to extend between said left top edge, said right top edge and said rear top edge and over said interior to define an access opening between said left side, said right side, said base and said cover means, said cover means being formed of a material that is resistant to the transmission of selected chemical and biological materials.

2. The disposable laboratory hood of claim 1, wherein said left side has a left front edge and a left slant edge extending from said left top edge to said left front edge, wherein said right side has a right front edge and a right slant edge extending from said right top edge to said right front edge, and wherein said cover means extends from said left top edge and said right top edge toward said front edge of said left side and said front edge of said right side along said left slant edge and said right slant edge.

3. The disposable laboratory hood of claim 2, wherein said cover means is sealed to said left slant edge and extends along said left slant edge to said left front edge, and wherein said cover means is sealed to said right slant edge and extends along said right slant edge to said right front edge, and wherein said cover means is formed of a transparent material.

4. The disposable laboratory hood of claim 3, wherein said left side is rotatable from a first position oriented toward said base and an upright position oriented generally normal to said base.

5. The disposable laboratory hood of claim 4, wherein said right side is rotatable from a first position oriented toward said base and an upright position oriented generally normal to said base.

6. The disposable laboratory hood of claim 5, wherein said rear side is rotatable from a first position oriented toward said base and an upright position oriented generally normal to said base.

7. The disposable laboratory hood of claim 6, wherein said left side has a rear edge, and wherein said rear side has a left edge, and wherein said disposable laboratory hood further includes a second left side sealingly connected to one of said rear edge of said left side and said left edge of said rear side, and wherein said disposable laboratory hood includes second left connecting means for connecting said second left side to one of said rear edge of said left side and said left edge of said rear side.

8. The disposable laboratory hood of claim 7, wherein said right side has a rear edge, and wherein said rear side has a right edge, and wherein said disposable laboratory hood further includes a second right side sealingly connected to one of said rear edge of said right side and said right edge of said rear side, and wherein said disposable laboratory hood further includes second right connecting means for connecting said second right side to one of said rear edge of said right side and said right edge of said rear side.

9. The disposable laboratory hood of claim 8, wherein said second left side and said second right side are each formed of said laminate material.

10. The disposable laboratory hood of claim 9, wherein said base has a front edge opposite said rear edge, wherein said disposable laboratory hood further includes a front side connected to said front edge of said base, said front side extending between the front edge of left side and the front edge of said right side, and wherein said front side extends from said base toward said cover means a preselected distance to cover said access opening.

11. The disposable laboratory hood of claim 10, including left front connection means for connecting said front side to said left side and right front connection means for connecting said front side to said right side.

12. The disposable laboratory hood of claim I 1, wherein said front is rotatable between an upright position oriented generally normal to said base and a second position oriented away from said first position.

13. The disposable laboratory hood of claim 12, wherein said front side has a left edge, wherein said left front connection means includes a left flap attached to said left edge and left locking means for removably locking said left flap to said left side.

14. The disposable laboratory hood of claim 13, wherein said front side has a right edge, wherein said right front connection means includes a right flap attached to said right edge and right locking means for removably locking said right flap to said right side.

15. The disposable laboratory hood of claim 14, wherein said left locking means includes a first button attached to said left flap and a second button attached to said left side and left securing means for inhibiting relative movement between said first button and said second button.

16. The disposable laboratory hood of claim 15, wherein said left securing means is a string.

17. The disposable laboratory hood of claim 16, wherein said right locking means includes a third button attached to said right flap and a fourth button attached to said right side and right securing means for inhibiting relative movement between said third button and said fourth button.

18. The disposable laboratory hood of claim 17, wherein said right securing means is a string.

19. The disposable laboratory hood of claim 14, wherein said left securing means is left tongue formed on the end of said left flap and a left slot formed in said left side sized to receive said left tongue in a frictional engagement.

20. The disposable laboratory hood of claim 19 , wherein said right securing means is a right tongue formed on the end of said right flap and a right slot formed in said right side sized to receive said right tongue in a removable frictional engagement.

21. The disposable laboratory hood of claim 18, wherein said laminate includes two layers one of which is cardboard.

22. The disposable laboratory hood of claim 21, wherein one of said two layers is an elastomeric film.

23. The disposable laboratory hood of claim 22, wherein said elastomeric film is sterilized.

24. The disposable laboratory hood of claim 1, wherein one of said left side, rear side and right side has an aperture formed therein with filter structure positioned proximate thereto to filter air moving through said aperture and wherein fan means is connected to said aperture to move air through said filter.

* * * * *